United States Patent [19]

Drazic

[11] Patent Number: 4,819,667

[45] Date of Patent: Apr. 11, 1989

[54] TREATMENT OF TOBACCO TO REDUCE TAR AND NICOTINE CONTENT

[76] Inventor: Nikola Drazic, 38 Evenlea Walk, Winnipeg, Manitoba, Canada, R2G 2N7

[21] Appl. No.: 80,081

[22] Filed: Jul. 31, 1987

[51] Int. Cl.[4] ..... A24B 15/28

[52] U.S. Cl. ..... 131/310; 131/298

[58] Field of Search ..... 131/297, 298, 309, 310

[56] References Cited

U.S. PATENT DOCUMENTS 2,136,485 11/1938 Berka et al. ..... 131/297

*Primary Examiner*—V. Millin

*Assistant Examiner*—J. Cheng

*Attorney, Agent, or Firm*—Adrian D. Battison; Stanley G. Ade

[57] ABSTRACT

The tar and nicotine content of tobacco is reduced by passing through the tobacco a combination of steam and starch cells.

12 Claims, No Drawings

TREATMENT OF TOBACCO TO REDUCE TAR AND NICOTINE CONTENT

BACKGROUND OF THE INVENTION

This invention relates to a process for treating tobacco and particularly for the purposes of reducing the content therein of nicotine and tar for use of the tobacco in smoking materials.

The use of tobacco particularly in smoking materials has received much condemnation from health authorities on the grounds that particularly the tar and nicotine content can be injurious to the health of the smoker or to those around the smoker. Over the years therefore the tobacco industry have attempted to reduce the amount of tar and nicotine passing from the cigarette or other smoking material to the user generally by providing filters of different types to extract the unwanted materials. Generally however there has been no reduction of the amount of tar or nicotine in the actual smoking material itself and the filter has been relied upon to filter out the materials rather than to have them removed in a previous process.

This technique is of course less satisfactory because the filter can only operate to a certain efficiency and also because much of the smoke does not in fact pass through the filter for example when the cigarette is merely burning in an ashtray.

Attempts have been made therefore over the years to develop process for reducing the tar and nicotine content of tobacco in a step prior to the manufacture of the cigarette.

It is believed however that none of the techniques has been satisfactory since there remains a strong requirement in the tobacco industry for a technique for reducing the tar and nicotine content of the tobacco and much interest is expressed in processes of this type.

It is accordingly one object of the present invention to provide an improved process for treating tobacco.

According to the invention, therefore, it is provided a process for treating tobacco comprising passing through the tobacco in combination steam and starch.

According to the second aspect of the invention, it is provided a process for treating tobacco comprising reducing the content therein of nicotine and tar by applying thereto a vapor obtained by boiling a mixture of water with a material having the characteristics of (a) It vaporizes with water;

(b) It acts as an absorbent for nicotine and tar.

In a small scale trial of the technique according to the present invention the following process parameters can be employed:

Elements used for the invention

1. Water
2. Starch (used parenchyma cells)
3. Heat
4. Metal Container
5. Sieve

Process

A metal container is filled with 2 liters of water. In the same container 20% of parenchyma cells are put in (20% of the amount of tobacco used; i.e. 200 grams of tobacco—to 40 grams of parenchyma cells or starch). A sieve is placed on top of the metal container. The sieve has to set properly and not allow any room to exist between itself and the walls of the metal container. The sieve should be as dense as possible.

The tobacco is placed in the sieve. The distance from water to tobacco should be of proportion so that the water does not and can not get in contact with the tobacco.

The higher the temperature the greater the distance should be.

Process Reaction

The water is brought to a boiling point. Parenchyma cells are in the water. As the water starts to evaporate, the steam containing contents of starch rises towards the tobacco. It passes throughout the tobacco and rises further into the air. As the steam passes through the tobacco, it softens the tobacco fibers and the starch portion collects tar and nicotine as it moves upward. Since the steam keeps moving upward it pulls with it tar and nicotine out of the tobacco.

Results

When the process is activated, the air above the tobacco is noticably changed. It gives a harsh smell of tar and nicotine. (This was tested in a room with no ventilation.)

Towards the end of the process the tobacco stems turn into a whitish color showing that a % of tar and nitcotine was extracted.

Upon smoking of the final product there is a very mild taste to the cigarette. Regular filter was used.

The length of smoking a cigarette is increased which substantiates the claim that there is less tar and nicotine.

| | TAR (MG) | NICOTINE (MG) | CO (MG) | PUFFS/ CIG | TAR/ LITER | NICOTINE/ LITER | CO/ LITER |
|---|---|---|---|---|---|---|---|
| | DATA FOR TOBACCO PRIOR TO TREATMENT | | | | | | |
| | 21.23 | 1.81 | 23.20 | 13.28 | 45.67 | 3.89 | 49.91 |
| | 20.34 | 1.56 | 20.80 | 9.96 | 58.36 | 4.48 | 59.67 |
| | 19.07 | 1.65 | 23.00 | 11.54 | 47.22 | 4.09 | 56.94 |
| | 19.54 | 1.72 | 22.20 | 12.40 | 45.01 | 3.96 | 51.15 |
| | 19.84 | 1.81 | 22.00 | 12.94 | 43.80 | 4.00 | 48.58 |
| | 18.42 | 1.64 | 20.60 | 13.26 | 39.68 | 3.53 | 44.39 |
| MEAN | 19.69 | 1.70 | 21.96 | 12.31 | 46.16 | 3.96 | 51.37 |
| STD DEV | 0.84 | 0.08 | 0.92 | 1.11 | 5.44 | 0.27 | 4.85 |
| LOWER CL | 18.94 | 1.62 | 21.14 | 11.32 | 41.30 | 3.73 | 47.04 |
| UPPER CL | 20.44 | 1.77 | 22.78 | 13.30 | 51.02 | 4.20 | 55.70 |
| | TREATED TOBACCO | | | | | | |
| | 19.53 | 1.54 | 20.40 | 12.86 | 43.40 | 3.42 | 45.32 |
| | 18.75 | 1.50 | 21.20 | 11.54 | 46.42 | 3.71 | 52.49 |
| | 19.84 | 1.58 | 20.00 | 11.75 | 48.28 | 3.85 | 48.67 |
| | 18.27 | 1.47 | 22.80 | 11.38 | 45.87 | 3.69 | 57.24 |

-continued

| | TAR (MG) | NICOTINE (MG) | CO (MG) | PUFFS/ CIG | TAR/ LITER | NICOTINE/ LITER | CO/ LITER |
|---|---|---|---|---|---|---|---|
| | 19.42 | 1.62 | 19.30 | 12.40 | 44.76 | 3.73 | 44.47 |
| | 15.70 | 1.38 | 16.50 | 13.90 | 32.27 | 2.84 | 33.92 |
| | 19.28 | 1.68 | 19.50 | 13.88 | 39.69 | 3.46 | 40.14 |
| MEAN | 18.69 | 1.54 | 19.96 | 12.53 | 42.96 | 3.53 | 46.04 |
| STD DEV | 1.31 | 0.09 | 1.79 | 0.98 | 5.03 | 0.32 | 7.16 |
| LOWER CL | 17.51 | 1.46 | 18.36 | 11.65 | 38.46 | 3.25 | 39.64 |
| UPPER CL | 19.86 | 1.62 | 21.56 | 13.41 | 47.45 | 3.81 | 52.44 |

The above tables show therefore a reduction of 9% each of the tar content, nicotine content and carbon monoxide content.

The effect of the invention is provided by the transportation through the tobacco product of the starch cells carried by the steam. Starch acts as an absorbent for the tar and nicotine so that it is extracted from the tobacco and carried away in the steam for later condensation and collection.

Alternative materials to starch may be possible with the characteristics of the material being that firstly they can be created into a vapor with the steam for transportation with the steam and secondly that the material acts as an absorbent for the tar and nicotine. Starch is a natural material which has advantages in this area because it has no problems of toxicity which could possibly be the result of other solvents. Various types of starch can be used, the selection of parenchyma cells being used in view of the expected effective nature of these.

The above process can be carried out at atmospheric pressure as a batch process as described above. Alternatively continuous processes may be used with the concentration of starch or the pressure or temperature of the vapors being modified to obtain an increased effect.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A process for treating tobacco comprising passing through the tobacco in combination steam and starch.

2. Tobacco when treated by the process according to claim 1.

3. The invention according to claim 1 wherein the proportion of starch to tobacco is of the order of 20% by weight.

4. Tobacco when treated by the process according to claim 3.

5. The invention according to claim 1 wherein the temperature of the vapor is of the order of 100° C.

6. Tobacco when treated by the process according to claim 5.

7. A process for treating tobacco comprising reducing the content therein of nicotine and tar by applying thereto a vapor obtained by boiling a mixture of water with starch.

8. The invention according to claim 7 wherein the proportion of starch to tobacco is of the order of 20% by weight.

9. Tobacco when treated by the process according to claim 4.

10. The invention according to claim 7 wherein the temperature of the vapor is of the order of 100° C.

11. Tobacco when treated by the process according to claim 5.

12. Tobacco when treated by the process according to claim 7.

* * * * *